US005373770A

United States Patent [19]

Dudley

[11] Patent Number: 5,373,770

[45] Date of Patent: Dec. 20, 1994

[54] QUICK-RELEASE DULCIMER CAPO

[76] Inventor: James T. Dudley, 4046 Breckenridge, Granite City, Ill. 62040

[21] Appl. No.: 140,861

[22] Filed: Oct. 25, 1993

[51] Int. Cl.[5] ..... G10D 3/00

[52] U.S. Cl. ..... 84/318

[58] Field of Search ..... 84/318, 315, 316, 317, 84/319

[56] References Cited

U.S. PATENT DOCUMENTS

| | | | |
|---|---|---|---|
| D. 281,508 | 12/1985 | McKinney | D17/20 |
| 470,560 | 3/1892 | Gassett | 84/318 |
| 3,834,267 | 9/1974 | Shubb et al. | 84/318 |
| 4,324,165 | 4/1982 | Wilkerson | 84/318 |
| 4,583,440 | 4/1986 | Powell, Jr. | 84/318 |
| 4,671,156 | 6/1987 | Hathcock | 84/318 |

OTHER PUBLICATIONS

Dulcimer Players News, p. 19; vol. 19, No. 3; Jul.–Sep., 1993.

Jean's Dulcimer Shop Price List, p. 1; Nov., 1990.

*Primary Examiner*—Michael L. Gellner
*Assistant Examiner*—Cassandra C. Spyrou
*Attorney, Agent, or Firm*—Don W. Weber

[57] ABSTRACT

A quick-release capo for a dulcimer musical instrument is presented. The capo body is an inverted U-shaped design having a fixed top and perpendicular side. A second perpendicular movable side is provided. Outside the movable side is a quick-release mechanism. The movable side and quick-release mechanism is adjusted to snugly fit across the dulcimer fret board by means of a thumbscrew and adjusting shaft. As the quick-release piece is adjusted inwardly by the thumbscrew, it compresses the movable side until the capo is snugly fit on the fret board. An L-shaped lever moves a non-concentric cam to alternately tighten or loosen the movable side. This L-shaped lever allows the user of the capo to quickly release and/or re-attach the capo to the dulcimer fret board.

4 Claims, 2 Drawing Sheets

QUICK-RELEASE DULCIMER CAPO

BACKGROUND OF THE INVENTION

This invention relates to a capo for a mountain dulcimer or other dulcimer. More particularly, it relates to a capo which may be quickly attached or detached from the fret board of a dulcimer musical instrument.

Many stringed instruments such as the guitar or dulcimer require the player of the instrument to change chords. Changing cords is accomplished by depressing the strings on the fret board at various lengths along the strings. This procedure is sometimes accomplished by hand, although it may also be conveniently accomplished by use of a capo.

Guitar capos are commonly known in the musical instrument industry. One such guitar capo is shown in the 1982 patent issued to Wilkerson, U.S. Pat. No. 4,324,165. This particular capo, and other capos found in the guitar industry, utilize an essentially L-shaped device which is attached to the string board to depress the strings at various lengths along the string board. Some of these capos are quick-release type of aids. However, the guitar capos are all distinct from a dulcimer capo due to the nature of a guitar as opposed to a dulcimer.

A guitar has a lower body and an extended and narrow neck or string board. This narrow string board allows the guitar capo to be attached around the entire string board. In the dulcimer application, the construction of the dulcimer makes it impossible to place the capo around a narrow extended string board since there is no extended string board about which to attach the capo.

A dulcimer is made of a body which has on its top, running along the length of the body, a raised fret board. The entire length of the fret board is attached to the lower dulcimer body thus making it impossible to attach a capo underneath the fret board. This feature renders the use of a guitar capo on a dulcimer impossible. Additionally, since dulcimers often utilize fewer strings than a guitar, it is common when playing the dulcimer to be required to change chords frequently and rapidly. Although known dulcimer capos have provided the capability for changing chords on the dulcimer, none of the prior art provides a dulcimer capo capable of quick-release and re-attachment.

It is an object of this invention to provide a capo which is capable of being attached to a dulcimer fret board. It is a further object of this invention to provide a dulcimer capo which may be quickly and easily attached and re-attached to a dulcimer fret board by means of a quick-attach lever. It is a still further object of this invention to provide a reliable and quickly removable dulcimer capo for use with a dulcimer stringed instrument.

Further and other objects of this invention will become apparent upon reading the below Specification.

BRIEF DESCRIPTION OF THE INVENTION

A quick-release dulcimer capo is provided having an essentially inverted U-shaped body. The top and one side of the U-shaped body are attached together in a perpendicular orientation while the other side of the U-shaped body is in a perpendicular relationship to the top but is movable across the length of the top. The movable side of the capo is adjusted by a thumbscrew and shaft so that the overall length of the capo from side to side may be conformed to the width of the capo fret board in use by adjusting the movable side.

Outside the movable end of the capo is a unique quick-attach lever and fastening piece. The sides of the U-shaped capo are adjusted to the width of the raised capo fret board, with the L-shaped lever pulled to the upright position. A non-concentric cam tightens the movable portion of the capo against the side of the raised fret board. Releasing the capo simply requires moving the L-shaped lever into the horizontal position, removing the side pressure of the non-concentric cam.

Inside the capo are cushioned pads so that the metal dulcimer capo does not harm the wooden dulcimer fret board. Changing chords in a quick and efficient manner can thus be accomplished by use of the quick-release dulcimer capo.

DETAILED DESCRIPTION OF THE PREFERRED EMBODIMENT

Figure 1:
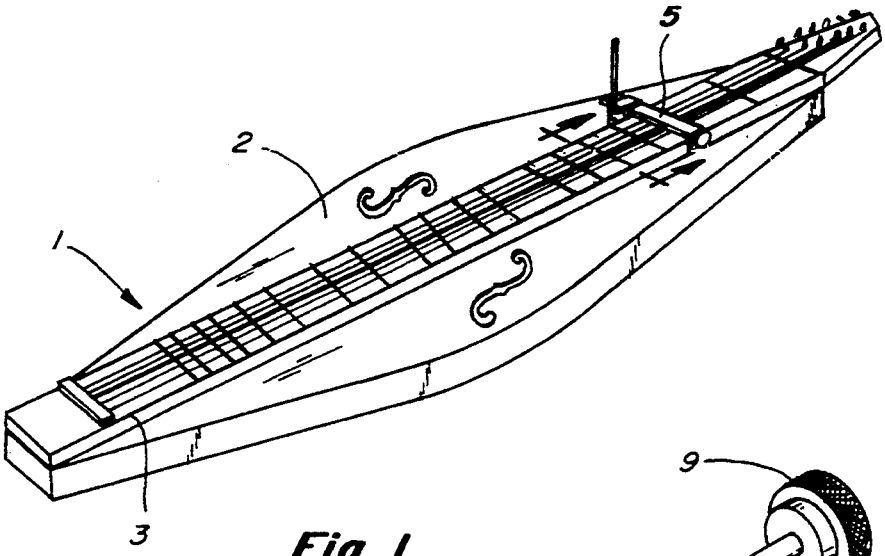
FIG. 1 is a perspective view of the dulcimer musical instrument with the quick-release capo attached to the fret board.

A dulcimer 1 is a musical instrument normally having three strings as opposed to the six strings of the guitar. Since the dulcimer normally has only three or four strings, it is frequently important to compress the strings with the player's hand or dulcimer capo in order to make different chords. The dulcimer has a flat body as shown on FIG. 1.

The flat body of the dulcimer 1 has a top 2. Attached to the top 2 of the dulcimer is a raised fret board 3. This raised fret board is shown on FIGS. 1, 3 and 4. This raised fret board 3 has dulcimer strings 4 strung along the length of the fret board 3. It is for the purpose of depressing these strings 4 along the length of the fret board 3 that the dulcimer capo 5 is designed.

Figure 2:
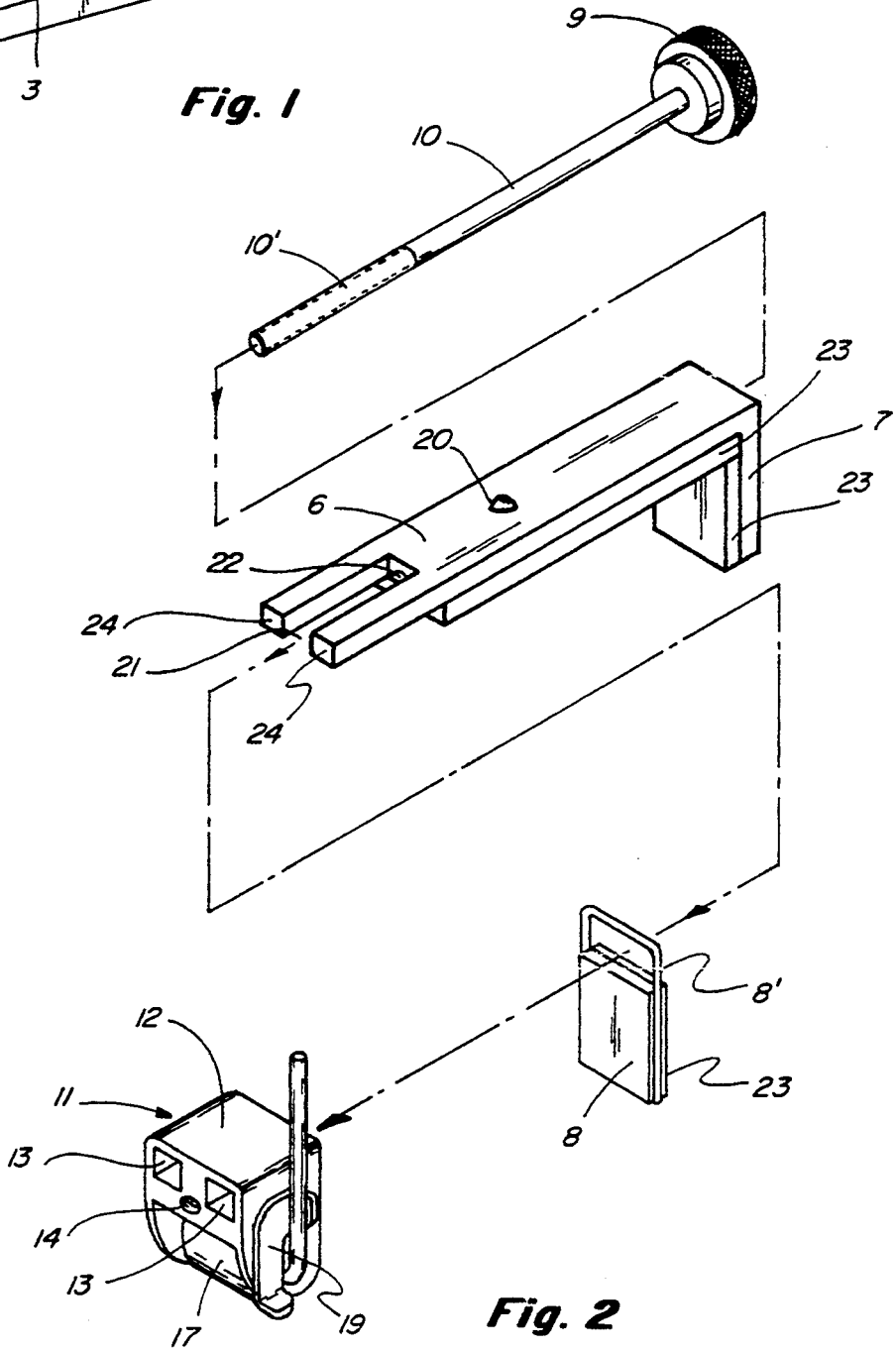
FIG. 2 is an exploded perspective view of the dulcimer capo.

The dulcimer capo 5 is shown in an exploded perspective view on FIG. 2. The capo consists of an essentially U-shaped main portion. This U-shaped main portion has a top 6 and a stationary side 7 which is located in a perpendicular orientation to the top 6.

The other side of the U-shaped capo body is a movable side 8. This movable side 8 is also arranged in a perpendicular orientation to the top 6 of the capo. However, the movable side is allowed to slide along the length of the top 6 of the capo between the movable side dimple 20 and the outer slotted prongs 24 of the top. The extreme outer edge of the device is defined by the positioning of the fastening piece 11.

The movable side 8 of the capo is attached around the top 6 of the capo by means of the upper portion 8' of the movable side 8.

The movable side 8 of the capo is adjusted to the particular width of the fret board 3 by means of the adjusting thumbscrew 9. The adjusting thumbscrew 9 is connected to a thumbscrew threaded shaft 10. This threaded shaft is inserted through the capo top threaded shaft passageway 22 so that the threaded end 10' of the threaded shaft 10 protrudes out the threaded shaft passageway 22 and into the capo top fastening piece slot 21.

With the adjusting thumbscrew and threaded shaft in place, and with the movable side of the capo attached between the dimple and the outer edge of the slotted end of the top 6 of the capo, the quick-attach fastening piece 11 may be attached to the capo.

The quick-attach fastening piece 11, best shown on FIG. 2, comprises an irregularly shaped body 12 having fastening piece slots 13 located in the upper part of the body as best shown on FIG. 2. These essentially rectangular slots 13 are arranged to accept the essentially rectangular prongs 24 located at the slotted end of the capo. Near the fastening piece slots 13 is a fastening piece threaded hole 14 adapted to receive the threaded end 10' of the adjusting thumbscrew 9 and threaded shaft 10.

Figure 4:
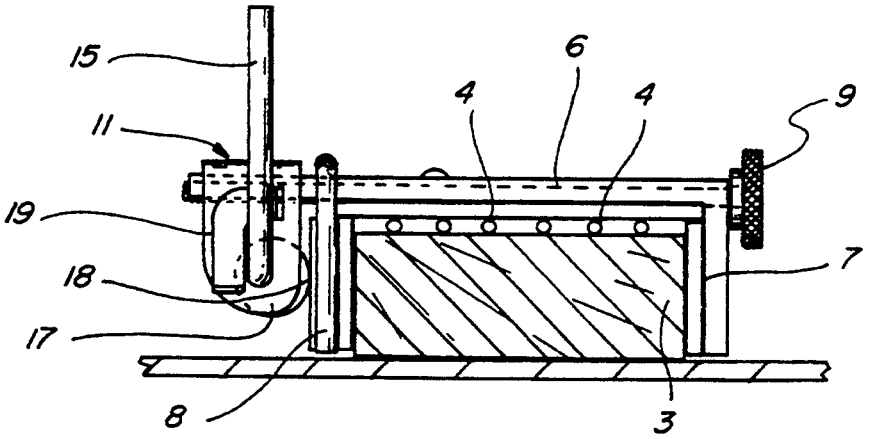
FIG. 4 is a side cut-away view of the dulcimer musical instrument showing the capo in its quick-attached position.
Figure 3:
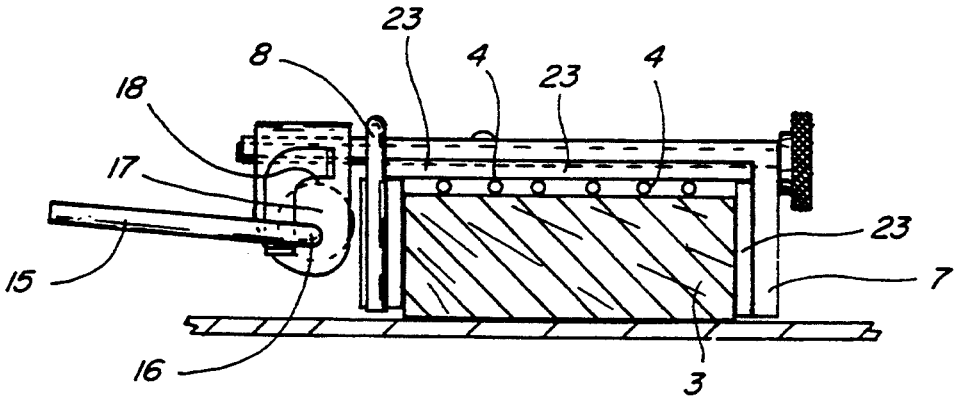
FIG. 3 is a side cut-away view of the dulcimer musical instrument and fret board showing the capo in its released position.

Once the fastening piece 11 is attached to the top 6 of the capo by means of the threaded shaft 10, threaded hole 14 and the fastening slots 13 and top prongs 24, the entire capo may be attached to the dulcimer, as shown in FIGS. 3 and 4.

Another important aspect of the fastening piece 11 is the quick-attach L-shaped lever 15 and the quick-attach L-shaped lever stop 19. The L-shaped lever 15 has one portion on the outside of the fastening piece 11 while a perpendicular portion of the L-shaped lever runs through the fastening piece 11. This lower portion of the L-shaped lever is connected to a non-concentric cam 17 and is secured to the non-concentric cam so that movement of the upper portion 15 of the L-shaped lever also rotates the non-concentric cam 17 about a quick-attach lever pivot point 16 located in the lower part of the fastening piece 11. This non-concentric cam, fastened about the perpendicular portion of the L-shaped lever 15, is essentially circular with a flat surface 18 located at one portion of the circumference of the cam 17.

Also attached to the inner portions of the U-shaped capo are cushioning pads 23 for use in cushioning the metal part of the capo which may be made of any type of pliable material with leather being the preferred type of material.

In order to attach the capo to the dulcimer musical instrument, one places the inverted U-shaped capo body on the raised fret board with the quick-attach L-shaped lever 15 in the vertical position, as shown on FIG. 9. The stationary side 7 of the capo is on one side of the fret board as shown on FIGS. 3 and 4 while the movable side 8 of the capo is snugly placed against the opposite side of the raised fret board. The adjusting thumbscrew 9 is then turned so that the fastening piece 11 presses the movable side of the capo 8 snugly against the fret board. Once both the stationary side 7 and movable side 8 of the capo is snugly fastened against the sides of the fret board and the strings 4 of the capo are depressed by the top 6, the quick-attach L-shaped lever 15 may be moved from the position shown in FIG. 4 to the position shown in FIG. 3 to release the capo from the fret board.

In the position shown in FIG. 4, with the L-shaped lever 15 in the vertical position, the flat portion 18 of the non-concentric cam forces the cam against the movable side 8 of the capo thus holding the capo in place. In order to quickly remove the capo from the dulcimer fret board, the L-shaped lever 15 is placed in the horizontal position as shown on FIG. 3. Moving the L-shaped lever from the vertical to the horizontal position disengages the flat portion 18 of the non-concentric cam, and hence the entire non-concentric cam from the movable side of the capo, as shown on FIG. 3. This allows the movable side 8 to move away from the fret board and allows easy and quick removal of the capo from the instrument. If it is desired to re-attach the capo quickly to another position on the fret board, the capo is simply moved to the correct position and the quick-attach L-shaped lever 15 is again placed in the vertical position thus securing the capo to the fret board.

The general shape of the dulcimer capo is shown and described above. While capos may be designed for different sizes and shapes of dulcimers, it has been found that one design will be capable of use on nearly all of the dulcimers currently in existence. The length of the top of the standard quick-release capo is approximately 2-13/16" while the width of the top is approximately ½". It has been found that the top and sides of the capo may preferably be made of approximately ⅛" thick brass. Each side of the capo will be approximately ⅞" in height with the movable side having a 9/16" solid piece and a 5/16" upper portion which is attached to the top of the capo. The cushioning pads 23 are preferably made of leather approximately ⅛" thick.

In the preferred embodiment, the adjusting thumbscrew 9 and threaded shaft 10 are approximately 3-1/16" in length with the final ⅞' of the threaded shaft actually having 6/32nds threads. The threaded shaft passageway 22 located in the top of the capo is similarly a 6/32nds hole. The quick-attach lever 15 has a vertical length of approximately 1-¾" while the perpendicular cam attaching portion is approximately ⅞" in length. The non-concentric cam 17 is approximately ⅜" in diameter with an off-set 5/32" hole for receiving the lower portion of the L-shaped lever. The cam also has a ⅛" flat machined onto the cam so that the flat surface 18 is in contact with the back side of the movable piece 8 to snugly secure the capo to the fret board.

It is recommended that the outer portion of the U-shaped capo, as well as the fastening piece 11, the non-concentric cam 17 and L-shaped lever 15 be made of brass. However, different types of metal may be used in practicing this invention while still keeping within the scope and spirit of the disclosure herein.

Although the preferred embodiment comprises an essentially U-shaped capo, different shaped capos may also be used, whether the outer design be for decorative or utility purposes while still keeping within the contemplation of this invention. While essentially exact measures have been given for certain dimensions of this invention herein, they are for means of illustration only and not as a limitation. Obviously, different dimensioned capos may be used for different applications while still keeping within the spirit of the invention. While the capo itself is designed for a dulcimer fret board, it may also be used on other types of stringed instruments requiring capos as long as the sides of the fret boards are essentially perpendicular to the top.

Having fully described my invention, I claim:

1. A capo for raised fret board of a dulcimer stringed instrument, said fret board having a rectangular cross-section consisting of a horizontal surface for supporting strings and two perpendicular vertical sides, comprising:

(a) a flat horizontal top having upper and lower surfaces and having a stationary vertical side fixedly attached to a first end of said top;

(b) an adjusting thumbscrew and shaft running through said flat top said shaft having a threaded end near a second end of said top;

(c) a fastening piece threadedly connected to the threaded end of said shaft; and (d) a second movable vertical side slidably attached to said horizontal top, located between said fastening piece and said first side, wherein said second side comprises a flat lower portion and a slotted upper portion, said slotted upper portion slidably secured about said flat top;

said fastening piece further comprising a rotatable quick-release L-shaped lever attached to a rotating non-concentric cam for securing said fastening piece and movable side against a vertical side of said fret board;

whereby the flat horizontal top of said capo is secured parallel to the horizontal surface and strings of said fret board and whereby the vertical sides of said capo are adjustably secured parallel to the vertical sides of said fret board.

2. A capo for the raised fret board of a dulcimer stringed instrument as in claim 1, further comprising cushioning pads located on the lower surface of said top and between the vertical sides of the fret board and the vertical sides of said capo.

3. A capo for the raised fret board of a dulcimer stringed instrument as in claim 1, further comprising a dimple on the upper surface of said top whereby the movement of said slidable second side of said capo is restricted.

4. A fret board capo for a dulcimer stringed instrument as in claim 1, further comprising a quick-attach lever stop located on one side of said fastening piece whereby the movement of said L-shaped lever is restricted.

* * * * *